US006354700B1

(12) United States Patent
Roth

(10) Patent No.: US 6,354,700 B1
(45) Date of Patent: Mar. 12, 2002

(54) TWO-STAGE PRINTING PROCESS AND APPARATUS FOR RADIANT ENERGY CURED INK

(75) Inventor: Joseph D. Roth, Springboro, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 08/803,968

(22) Filed: Feb. 21, 1997

(51) Int. Cl.[7] ..... B41J 2/01
(52) U.S. Cl. ..... 347/103; 347/102
(58) Field of Search ..... 347/96, 101, 102, 347/103; 399/266

(56) References Cited

U.S. PATENT DOCUMENTS

| | | | | | |
|---|---|---|---|---|---|
| 4,293,866 | A | * | 10/1981 | Takita et al. | 347/103 |
| 4,516,140 | A | | 5/1985 | Durkee et al. | |
| 4,809,021 | A | * | 2/1989 | Ckeck et al. | 347/251 |
| 4,836,102 | A | | 6/1989 | Cicci | |
| 4,989,343 | A | | 2/1991 | Ericsson | |
| 5,041,846 | A | * | 8/1991 | Vincent et al. | 347/25 |
| 5,397,673 | A | * | 3/1995 | Watson et al. | 430/126 |
| 5,471,233 | A | * | 11/1995 | Okamoto et al. | 347/103 |
| 5,510,822 | A | | 4/1996 | Vincent et al. | |
| 5,571,766 | A | | 11/1996 | Imai et al. | |
| 5,623,296 | A | * | 4/1997 | Fujino et al. | 347/103 |
| 5,641,346 | A | | 6/1997 | Mantell et al. | |
| 5,936,008 | A | * | 8/1999 | Jones et al. | 523/161 |

FOREIGN PATENT DOCUMENTS

| | | | | |
|---|---|---|---|---|
| EP | 0601531 | | 6/1994 | |
| EP | 0604023 | | 6/1994 | |
| EP | 0604024 | | 6/1994 | |
| JP | 62092849 | * | 4/1987 | 347/102 |
| JP | 401133746 | * | 5/1989 | 347/103 |
| JP | 3169634 | | 7/1991 | |
| JP | 6122194 | | 5/1994 | |

OTHER PUBLICATIONS

Patent Abstracts of Japan, vol. 015, No. 182 (M–1111), May 10, 1991, & JP 03 043256 A (Alps Electric Co Ltd), Feb. 25, 1991.

Patent Abstracts of Japan, vol. 014, No. 276 (M–0984), Jun. 14, 1990 & JP 02 081688 A (Tiyo Ink Mfg Co Ltd), Mar. 22, 1990.

Patent Abstracts of Japan, vol. 013, No. 380 (M–863), Aug. 23, 1989 & JP 01 133746 A (Seiko Epson Corp), May 25, 1989.

* cited by examiner

*Primary Examiner*—John Barlow
*Assistant Examiner*—M. Brooke
(74) *Attorney, Agent, or Firm*—Millen White Zelano & Branigan PC

(57) ABSTRACT

A printing process and apparatus are described which employ radiation curable inks and provide high resolution print at high speeds by a two-stage process where the image is formed on an intermediate substrate and then transferred to the print medium. This allows both sides of the printed image to be exposed to radiant energy and also allows the printed image to be exposed to both heat and radiant energy before transfer to the print medium.

12 Claims, 5 Drawing Sheets

TWO-STAGE PRINTING PROCESS AND APPARATUS FOR RADIANT ENERGY CURED INK

BACKGROUND OF THE INVENTION

The invention relates to printing methods and apparatus which employ inks curable by radiant energy. The methods and apparatus are adaptable for use with ink jet print heads and thermal transfer print heads.

In conventional printing processes and apparatus which employ inks curable by radiant energy, particularly those which employ ink jet print heads and thermal transfer print heads, it is difficult for light or other radiant energy to penetrate colored ink layers. The pigments and dyes block or absorb the radiant energy, reducing the energy available to initiate the polymerization and often resulting in surface cure. The degree of cure decreases with increasing depth within the ink layer. It is desirable to provide a method and apparatus which will more thoroughly cure radiation curable inks with such pigments and dyes.

Ink jet printers are likely to find increased use as the technology is advanced due to high print speeds and economy of operation. Typical ink jet printers operate by employing a plurality of actuator elements to expel droplets of ink through an associated plurality of nozzles. A typical print head actuator is described in U.S. Pat. No. 4,516,140. Each actuator element is typically located in a chamber filled with ink supplied from a reservoir. Each actuator element is associated with a nozzle that defines part of the chamber. On energizing a particular actuator element, a droplet of ink is expelled through the nozzle toward the print medium either by pressure or vaporization. Those wherein the ink is drawn through the nozzle by an electrostatic field are also known. In most configurations, the print head containing the nozzles is moved repeatedly across the width of the print medium on guide rails. After each movement, the print medium is advanced to the width of the swath for the next pass of the pen. In some configurations, such as in high volume printers, the print head extends across the full width of the print medium. At a designated number of increments, each of the nozzles are caused to either eject ink or refrain from ejecting ink. The movement over the medium can print a swath approximately as wide as the number of nozzles arranged in the column.

These conventional ink jet printing methods and apparatus have limitations. Such printing methods often suffer in definition and quality and, in some cases, print speed due to the low viscosity required of the ink employed. Low viscosity values for the ink are required to enable ejection from the print head. This often necessitates high solvent content. The high solvent content requires that the ink be drawn into the print medium to enable rapid drying. When such inks are drawn into the print media, the edges tend to become less defined. Inks of different colors may bleed into each other when drawn into the absorptive print media. Where the print media has a low absorption rate for the ink, such as transparency film, the ink tends to clump together due to surface tension. In addition, print speed is reduced since the ink takes a longer time to dry on the non-absorptive substrate. Another problem which may be encountered in ink jet printing is paper cockle, wherein the print media swells once the ink is absorbed, causing the paper to warp (cockle). It is desirable to provide an ink jet printing method and apparatus wherein the print quality and print speed do not suffer from the high solvent content of the ink.

In thermal transfer printing, images are formed on a receiving substrate by heating extremely precise areas of a print ribbon with thin film resistors. This heating of the localized area causes transfer of ink or other sensible material from the ribbon to the receiving substrate. The sensible material is typically a pigment or dye. These techniques provide images with higher definition and quality than ink jet methods in that high viscosity inks are used which need not wick into the receiving medium. Print speed is not delayed by wicking of the ink. However, UV curable inks and visible light curable inks suffer from surface cure because of limits on penetration of radiant energy.

SUMMARY OF THE INVENTION

It is an object of the present invention to provide a printing process and apparatus for radiant energy cured ink wherein surface cure is reduced or eliminated.

It is another object of the present invention to provide a printing process and apparatus for radiant energy cured ink wherein cure of the ink is accelerated.

It is an additional object of the present invention to provide a printing process and apparatus for radiant energy cured inks which employ inks with a high solvent content wherein wicking of solvent in the print medium is reduced or eliminated.

It is a further object of the present invention to provide a printer which employs an ink jet print head and provides printed images with improved definition and quality at high speeds.

It is an additional object of the present invention to provide a printing process and apparatus which employ an ink jet print head and radiation curable inks which form ink images with improved definition and quality.

Upon further study of the specification, drawings and appended claims, further objects and advantages of this invention will become apparent to those skilled in the art.

The above objects are achieved through the method and apparatus provided by this invention. In the method aspect of this invention, there is provided a two-stage printing process for radiant energy cured ink which comprises depositing such an ink in the form of an image on the surface of an intermediate substrate. The ink image formed has an upper surface and a lower surface. The upper surface of the image on the intermediate substrate is exposed to radiant energy to at least partially cure the ink image. This exposed ink is then transferred from the intermediate substrate to a receiving substrate, wherein the image and its surface are reversed to form a transferred ink image. This transferred ink image on the receiving substrate is then optionally exposed to radiant energy to further cure the ink.

In preferred embodiments, the ink is deposited on the intermediate substrate by an ink jet print head, although use of other printing techniques, such as thermal transfer printing, is also suitable. In addition, in preferred embodiments, the radiant energy is ultraviolet light; however, the use of visible light or infrared radiation is also suitable. In curing the ink both before and after transfer to the receiving substrate, both sides of the ink can be cured, allowing greater penetration of radiation and elimination of single surface cure.

There is also provided a variation of this process wherein the ink is deposited on an intermediate substrate, exposed to radiant energy and transferred to a receiving substrate as described above but the ink image is also heated to a temperature above the ambient temperature on the intermediate substrate and the transferred image cooled to ambient temperature. In this method, exposing the transferred ink image on the receiving substrate to radiation is optional.

In another aspect of this invention, there is provided a printer which comprises an image forming member adapted to form images with an ink curable by radiant energy, an intermediate substrate positioned to receive ink images from said image forming member, an advancing mechanism for moving the surface of the intermediate substrate relative to the image forming member, a radiant energy source positioned to expose the ink images on the surface of the intermediate substrate, a feeding mechanism for receiving substrates and transferring the ink image to a receiving substrate and a second radiant energy source to expose the transferred ink image to radiant energy.

There is also provided a variation of this printer where the image forming member is an ink jet print head. There is included a means for heating the ink image on the intermediate substrate above ambient temperature. With such devices, the second radiant energy source is optional.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF PREFERRED EMBODIMENTS

The present invention is directed to printing methods and printers and are independent of the means of forming an image, which are typically print heads. There is no particular restriction on the print head as long as it can form an image with radiant energy curable ink. Suitable print heads include ink jet print heads and thermal transfer print heads. Suitable ink jet print heads are those which actuate thermally, by a piezoelectric crystal or an electrostatic field. The embodiments described herein often refer to ink jet print heads; however, the invention is not limited thereto.

The printing processes and printers of the present invention employ a radiant energy cured ink and an intermediate substrate upon which an ink image is formed with the radiant energy curable ink. The use of the intermediate substrate provides many advantages, some of which include 1) a two-stage cure for the radiation curable ink, allowing both sides of the ink image to be exposed to radiant energy for a more complete and faster cure, and 2) a cure wherein wicking of the solvent does not occur on the final print medium.

Figure 1:
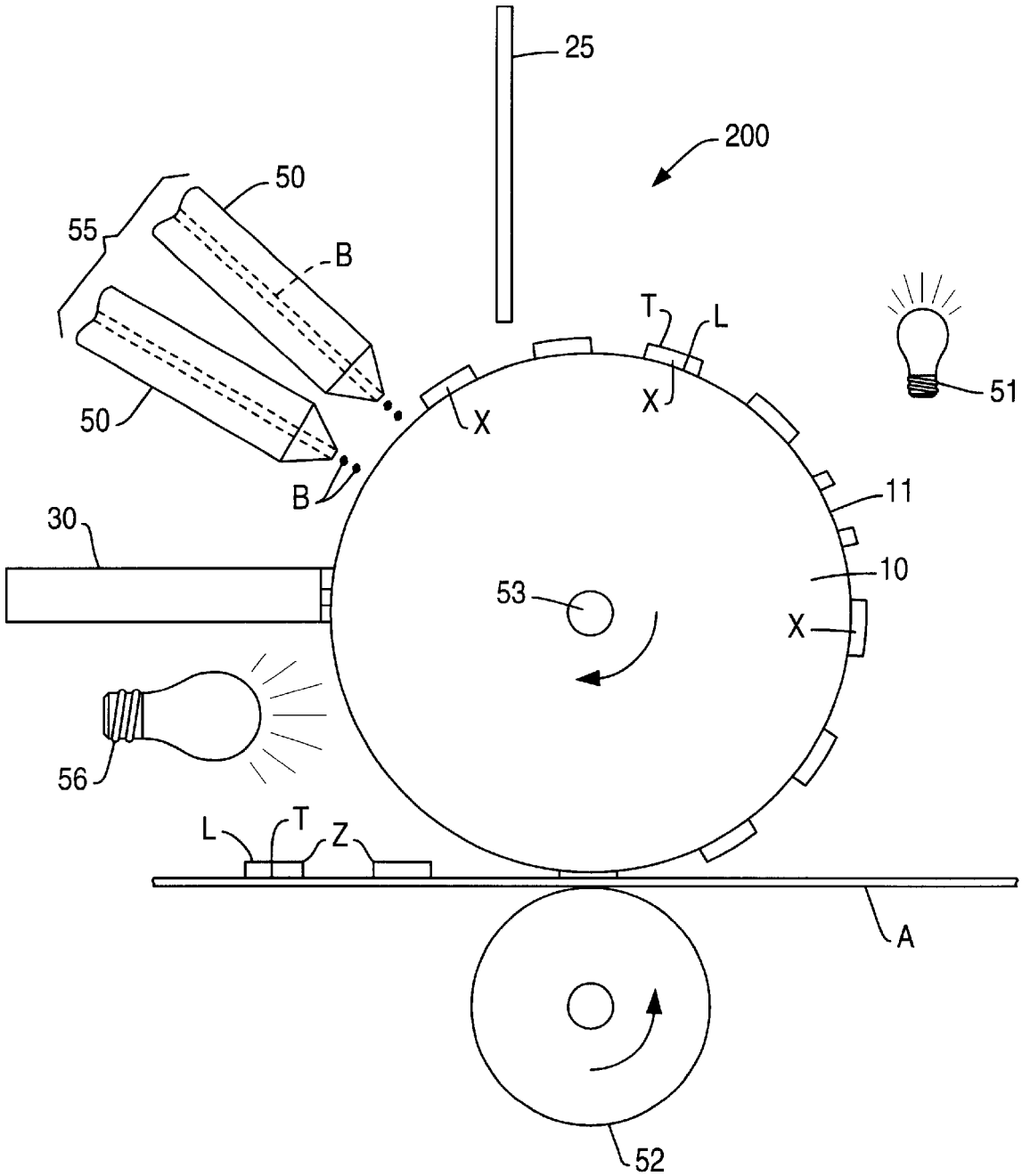
FIG. 1 is a schematic representation of an embodiment of a printer provided by this invention which employs a transfer roller as an intermediate substrate.

FIG. 1 shows a Printer 200 of the present invention and illustrates in principle an example of a printing method of the present invention as well. Printer 200 employs two ink jet print heads 50 as an image forming member 55. However, the printers and processes of the present invention include the use of a) single ink jet print heads, b) more than two ink jet print heads, c) thermal transfer print heads and other means for depositing ink as image forming members. The intermediate substrate employed in Printer 200 is transfer roller 10. The ink jet print heads 50 form an ink image on transfer roller 10 by depositing ink B on surface 11. Surface 11 of transfer roller 10 is moved relative to the image forming member 55 to allow further deposition of ink B thereon. An advancing mechanism provides such relative motion. For Printer 200, pressure roller 52 serves as the advancing mechanism. Pressure roller 52 rotates transfer roller 10 about its axis 53 while moving receiving substrate A between pressure roller 52 and transfer roller 10. The advancing mechanism can vary widely in structure and includes a simple drive means for rotating transfer roller 10 about axis 53.

Radiant energy source 51 exposes ink images X on surface 11 of transfer roller 10. The ink images are at least partially cured from this exposure. The exposed ink image is then transferred to a receiving substrate A. This is accomplished by a feeding mechanism adapted to move receiving substrates so that they contact and overlap the ink images on the intermediate substrate. In Printer 200, pressure roller 52 serves as a feeding mechanism which moves receiving substrate A so that it contacts and overlaps ink images X on surface 11 of transfer roller 10. The pressure applied by roller 52 is such that the ink image X transfers to receiving substrate A to form ink image Z. The feeding mechanism can vary widely in structure and operation. Transfer of the exposed ink image X on the intermediate substrate to a receiving substrate reverses the top surface T and lower surface L of the ink image X in forming a transferred image Z. In Printer 200, a second radiant energy source 56 exposes the transferred ink images Z to radiant energy. The second radiant energy source is an optional feature in some embodiments of this invention where the radiant energy source 51 incompletely cures the ink image.

Figure 2:
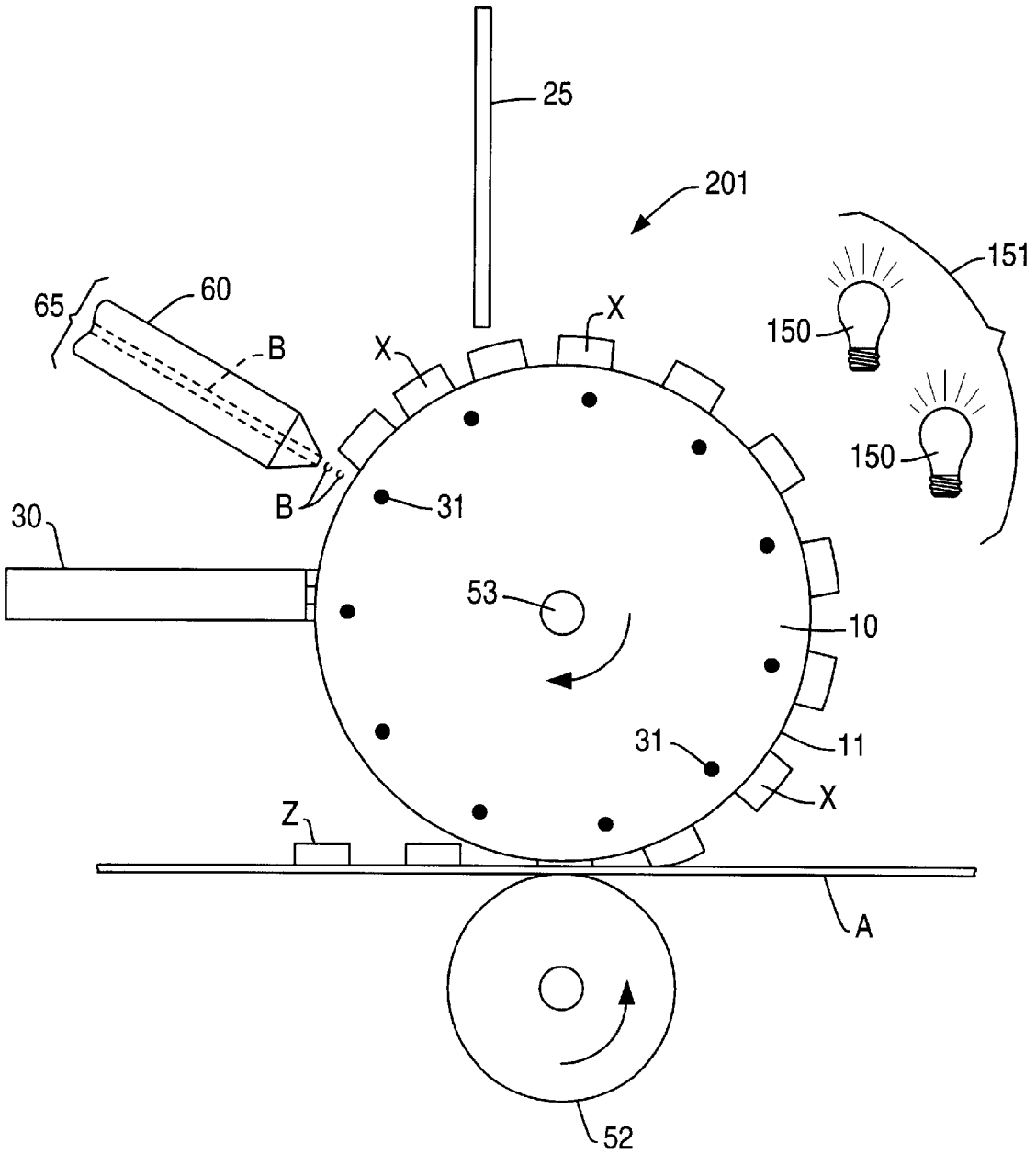
FIG. 2 is a schematic representation of another embodiment of a printer provided by the present invention which employs a transfer roller as an intermediate substrate.

An embodiment of a printer which employs only one radiant energy source is shown in FIG. 2. Printer 201 comprises a single ink jet print head 60 as an image forming member 65 which deposits ink B on surface 11 of transfer roller 10. An advancing mechanism as used in Printer 200 of FIG. 1, is employed in Printer 201. Pressure roller 52 serves as an advancing mechanism in rotating transfer roller 10 so as to move surface 11 relative to ink jet print head 60. Radiant energy source 151 via bulbs 150 exposes ink images X on the surface 11 of the transfer roller 10 to radiant energy and can completely cure ink image X. Printer 201 additionally contains a means for heating ink image X to a temperature above ambient temperature. Bulbs 150 also serve as a means for heating the ink images X to a temperature above ambient temperature. An alternative embodiment is to preheat transfer roller 10, which can be accomplished by thermal resistance heaters 31. These can be configured analogously to the transfer rollers used in conventional laser printers and photocopies which fuse dry toner. The exposed and heated ink image X is then transferred to a receiving substrate A by pressure roller 52 in a manner as described for Printer 200 of FIG. 1. The transferred ink image Z need not be exposed to a second radiant energy source if the ink is completely cured. However, the transferred ink image is allowed to cool to ambient temperature so as to harden and reduce tackiness.

To increase tackiness, the ink on the intermediate substrate may be heated in a number of ways such as by radiant energy source as in printer 201 of FIG. 2, by transferring heat from pressure roller 52, by resistance heaters or by hot air flows (not shown).

Combinations of devices can be used to heat the ink image. Such heating means may optionally be used with a printer having two radiant energy sources as in Printer 200 of FIG. 1.

Printers 200 and 201 each contain barrier 25. This barrier serves to isolate the image forming members 50 and 60 from radiant energy. Such a barrier is optional and may be superfluous depending upon the position of the radiant energy source and image forming member. Printers 200 and 201 also each contain an optional cleaning wand 30. The cleaning wand removes any residual ink which has not transferred to a receiving substrate from the intermediate substrate.

The radiant energy emitted by the radiant energy source is preferably ultraviolet light, visible light, infrared radiation or a combination thereof. The radiant energy source selected is dependent on the cure mechanism for the ink employed. Inks cured by ultraviolet light are common and such radiant energy sources are preferred.

The process and apparatus of this invention provides an advantage in that where curing with radiant energy is difficult to complete, the ink image can be exposed to radiant energy on both upper and lower surfaces due to their reversal upon transfer of the ink images from the intermediate substrate to the receiving substrate. Inks can be easily formulated to be completely cured upon transfer to the receiving substrate. Inks may also be formulated to be completely cured in advance of transfer. Inks which are formulated to be completely cured by the single radiant energy source also benefit from the use of intermediate substrate where deposited by an ink jet print head in that solvents required to aid in the deposition and formation of the ink image from such print heads are removed by heating the ink image; thereby reducing the impact such solvents have on image receiving substrates such as paper. Heating the ink image on the intermediate substrate also provides the opportunity to enhance the reaction kinetics. It is necessary to heat the completely cured ink image to a temperature above ambient temperature to soften the ink image and enable transfer to a receiving substrate where it solidifies to a tackfree solid at room temperature.

As indicated previously, the image forming member that is employed in the printer of the present invention can vary widely in structure from ink jet print heads to thermal transfer print heads. Such print heads need not vary from conventional print heads. Whether thermal, electrostatic or those activated by piezoelectric crystals, such print heads preferably have a plurality of nozzles to accommodate various colors. Thermal transfer print heads are less favored in that the inks deposited are solid at ambient temperature requiring the ink to be heated so as to allow for eventual transfer of the ink image from the intermediate substrate to a receiving substrate.

Figure 3:
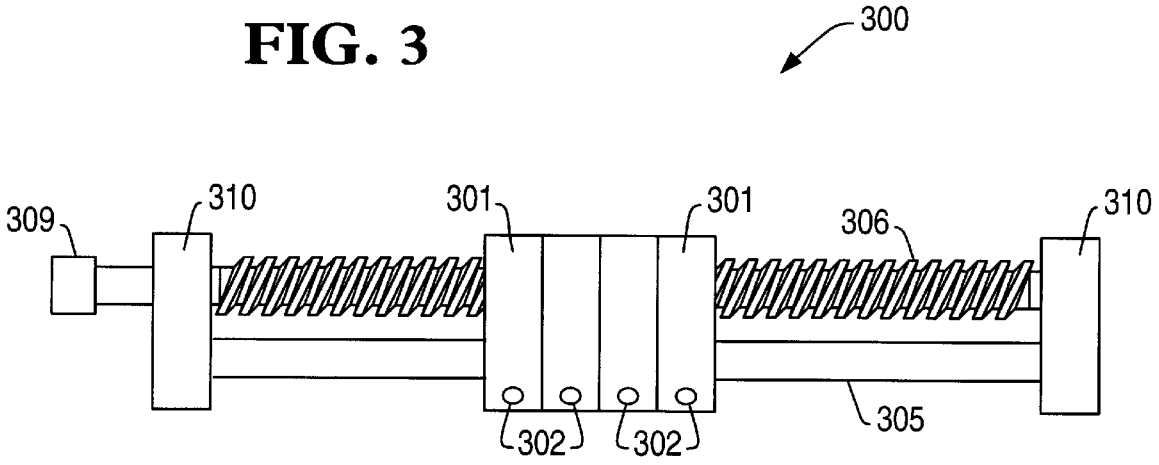
FIG. 3 is a schematic representation of a carriage for an ink jet print head suitable for use in the present invention.
Figure 6:
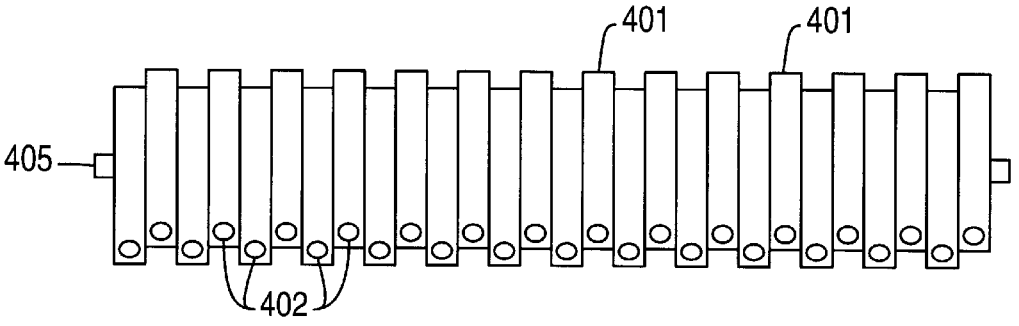
FIG. 6 is a schematic representation of a full width ink jet print head.

The image forming member may be include guide rails or other mechanism which allows the print head to traverse the intermediate substrate surface in a direction perpendicular to movement of said advancing mechanism. FIG. 3 illustrates such an embodiment in image forming member 300, which comprises ink jet print head 301 with four nozzles 302. Print head 301 is mounted on guide rail 305 and drive screw 306 is threaded through print head 301 so that print head 301 slides along guide rail 305 when drive screw 306 is turned clockwise or counterclockwise by driver 309. Frame members 310 support guide rail 305 and drive screw 306. The image forming member may comprise a print head which spans the full width of the transfer medium or a substantial portion thereof, as shown in FIG. 6, where image forming member 400 comprises print head 401 with multiple nozzles 402 mounted on rail 405.

The intermediate substrate is preferably a drum or roller as illustrated in FIGS. 1 and 2. However, it is contemplated that the dimensions and configuration of intermediate substrate can vary significantly as needed. For example, the intermediate substrate can comprise individual plates, or a continuous belt or ribbon.

Figure 4:
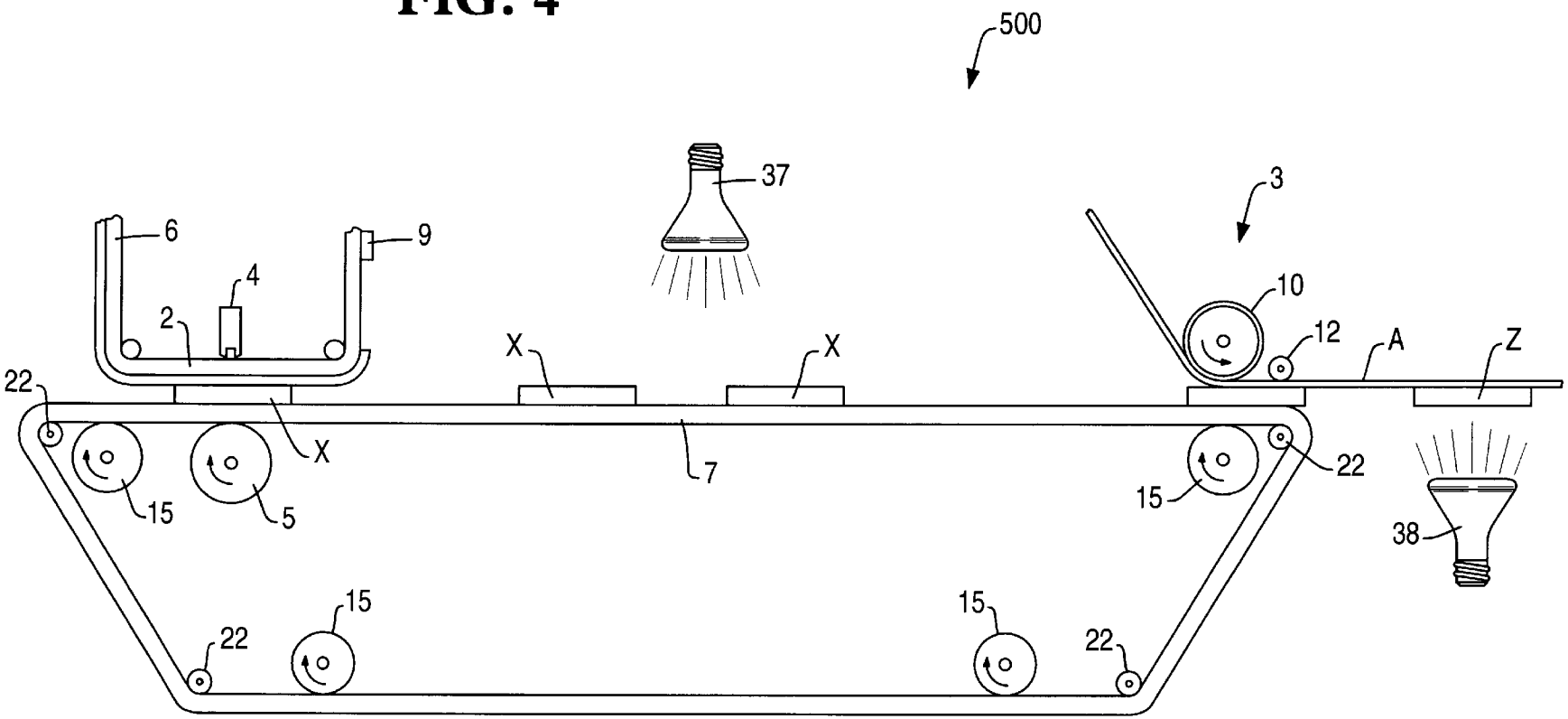
FIG. 4 is a schematic representation of an embodiment of a printer provided by the present invention which employs a continuous belt or ribbon as an intermediate substrate.

FIG. 4 illustrates an embodiment of this invention wherein the intermediate substrate is a continuous belt or ribbon. FIG. 4 illustrates a printer 500 of the present invention which employs a continuous belt 7 as an intermediate substrate. Thermal transfer print head 4 in combination with thermal transfer print ribbon 6 provides the image forming member 2. Ink 9 of ribbon 6 is transferred to continuous belt 7 in the form of an ink image X. The continuous belt 7 is moved relative to the image forming member 2 by a series of drive rollers 15 and guide rollers 22. Radiant energy source 37 radiates images X on the continuous belt 7. Feeding mechanism 3 moves receiving substrate A so that it contacts and overlaps ink image X on continuous belt 7 and transfers the ink image X to receiving substrate A. Feed mechanism 3 comprises drive roller 10 which feeds receiving substrate A to pressure roller 12 which presses receiving substrate A against the continuous belt 7 for transfer of ink image X. If desired, the transferred ink image Z on the receiving substrate is exposed to a second radiant energy source 38. Heat is applied to ink image X to enhance tackiness and improve transfer to receiving substrate A. In Printer 500, heat is applied to the ink image X through pressure roller 12 and by the radiant energy source 37.

Figure 5:
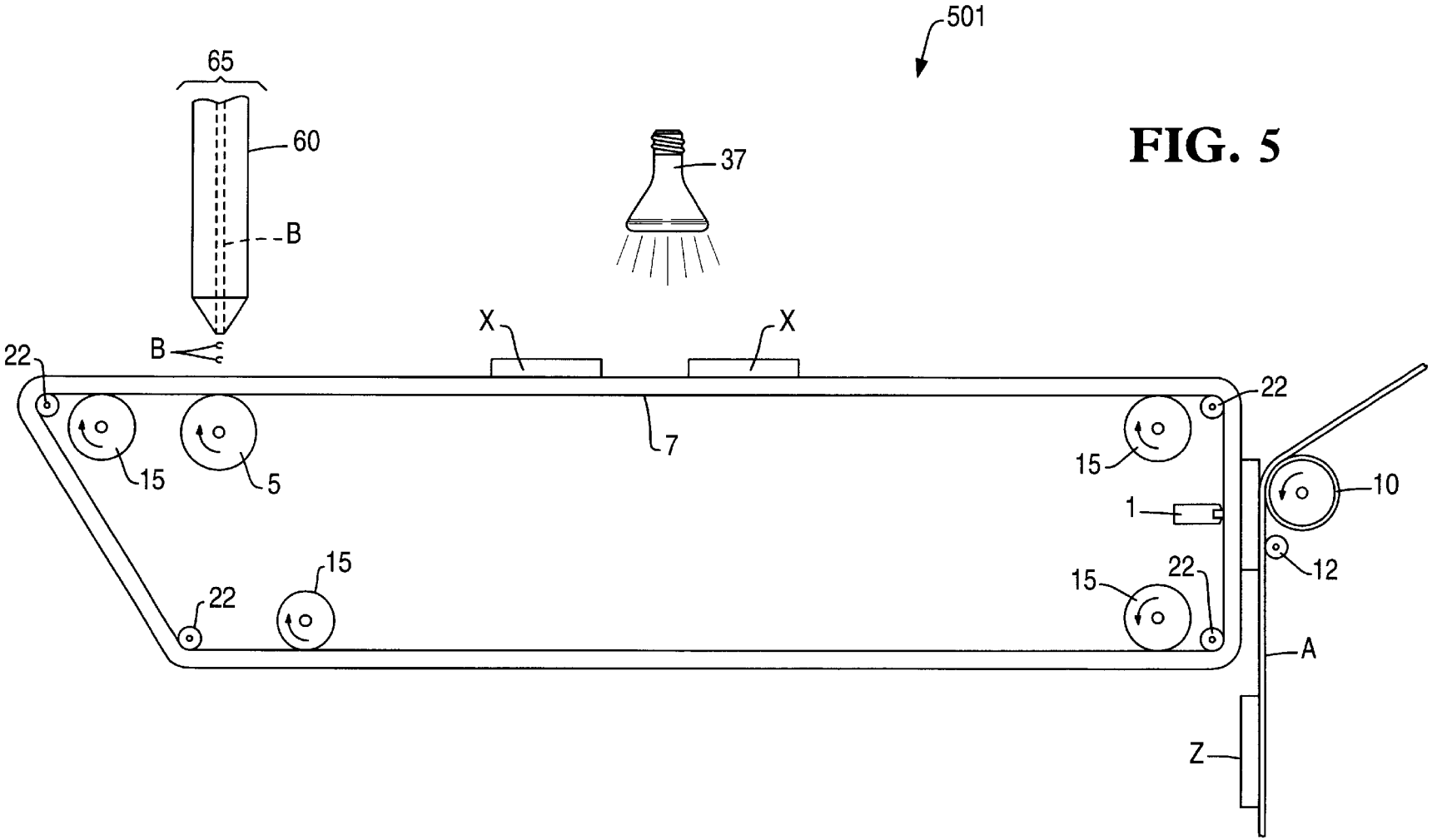
FIG. 5 is a schematic representation of another embodiment of a printer provided by the present invention which employs a continuous belt or ribbon as an intermediate substrate.

An alternative embodiment is printer 501 shown in FIG. 5, which employs an ink jet print head 60 as the image forming member 65 and a thermal transfer print head 1. similar to print head 4 of FIG. 4, to heat the image X. Print head 1 transfers the ink image from continuous ribbon 7 to receiving substrate A, after exposure to radiant energy. It is obvious that the intermediate substrates do not need to be the belt itself, but can be planar or three-dimensional substrates, positioned on the belt. With such embodiments, inks can be applied to receiving substrates with three dimensional shapes such as bottles, jars and boxes.

The most common receiving substrate is paper sheets, including strip paper, art paper, colored paper and continuous rolls. However, the process and apparatus of the present invention are well suited for use with plastic sheets, plastic films, as well as three-dimensional objects, such as plastic bottles or cardboard boxes, as receiving substrates.

It is obvious that the advancing mechanism and feeding mechanism can vary widely in configuration and structure. Various drive means can be used to advance the intermediate substrates such as motors, pulleys, chains, pneumatic drives, etc. Various pressure rollers and feed configurations can be used to feed planar receiving substrates for transfer of the ink image. More complex assemblies are required for three dimensional receiving substrates such as bottles and boxes.

The entire disclosures of all applications, patents and publications, cited above and below, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A two-stage printing process which comprises:

a) depositing ink in the form of an image on a surface of an intermediate substrate from an ink source, said ink being curable by radiant energy and the ink image has an upper surface and lower surface;

b) exposing the upper surface of the ink image on the intermediate substrate to radiant energy to partially cure said ink image; and c) transferring the exposed ink image on the intermediate substrate to a receiving substrate such that the upper surface and lower surface of the ink image are reversed in forming a transferred ink image on the receiving substrate; and d) exposing the upper surface of the transferred ink image on the receiving substrate to radiant energy to further cure said transferred ink image.

2. A process as in claim 1, wherein the ink source from which the ink is deposited on a surface of an intermediate substrate is an ink jet print head and the ink is deposited by ejection from said ink jet print head.

3. A process as in claim 1, which additionally comprises moving the surface of the intermediate substrate upon which the ink image is deposited from the ink source prior to exposing the upper surface of the ink image on the intermediate substrate to radiant energy.

4. A process as in claim 3, wherein the intermediate substrate is a transfer roller which rotates to provide movement of the surface upon which the ink image is deposited relative to the ink source.

5. A process as in claim 4, wherein the ink source scans the surface of the intermediate substrate in a direction perpendicular to the rotational direction of the transfer roller.

6. A process as in claim 4, wherein the ink source is stationary and deposits ink without scanning the surface of the intermediate substrate in a direction perpendicular to the rotational direction of the transfer roller.

7. A process as in claim 3, wherein the intermediate substrate is a belt which rotates to provide movement of the surface upon which the ink image is deposited relative to the ink source.

8. The process as in claim 3, wherein the radiant energy is selected from ultraviolet light, visible light, infrared radiation and combinations thereof.

9. A process as in claim 1 which additionally comprises heating the ink image on the intermediate substrate to a temperature above ambient temperature and cooling the transferred ink image on the receiving substrate to ambient temperature.

10. A process as in claim 9, wherein the ink image on the intermediate substrate is heated to a temperature above ambient temperature by heating the intermediate substrate before said ink image is deposited thereon.

11. A process as in claim 9, wherein solvents are removed from the ink image on the intermediate substrate prior to transfer to the receiving substrate.

12. A process as in claim 1, wherein the transferred ink image on the receiving substrate is cured to a dry ink after exposing the upper surface of the transferred ink image to radiant energy.

* * * * *